US005727981A

United States Patent [19]

Meng-Suen

[11] Patent Number: 5,727,981

[45] Date of Patent: Mar. 17, 1998

[54] MECHANICAL CLIMBING TOY

[75] Inventor: Huang Meng-Suen, Kowloon, Hong Kong

[73] Assignee: Mr. Christmas, Inc., New York, N.Y.

[21] Appl. No.: 719,675

[22] Filed: Sep. 25, 1996

[51] Int. Cl.[6] ..... A63H 11/04

[52] U.S. Cl. ..... 446/315; 446/354; 4/418

[58] Field of Search ..... 446/315, 314, 446/353–356; 40/414, 411, 418, 419, 415

[56] References Cited

U.S. PATENT DOCUMENTS

| | | | |
|---|---|---|---|
| 243,439 | 6/1881 | Farnum | 446/315 |
| 485,713 | 11/1892 | Shattuck | 446/315 |
| 568,854 | 10/1896 | Kenny . | |
| 1,267,608 | 5/1918 | Vaughan | 446/315 |
| 1,462,090 | 7/1923 | Lindstrom | 446/315 |
| 2,064,119 | 12/1936 | Irenius | 446/315 |
| 2,304,697 | 12/1942 | Kreutzer . | |
| 3,916,548 | 11/1975 | Langer | 40/106 |
| 3,983,661 | 10/1976 | Zitzmann | 446/315 |
| 4,245,486 | 1/1981 | Matsumoto et al. | 63/23 |
| 5,320,572 | 6/1994 | Chen | 446/315 |

*Primary Examiner*—Mickey Yu
*Attorney, Agent, or Firm*—Fitzpatrick, Cella, Harper & Scinto

[57] ABSTRACT

A climbing toy includes an upper line, a lower line and an upper reel mechanism from which the upper line depends and which selectively winds in the upper line. An action figure is connected to a lower end of the upper line. A lower reel mechanism is disposed in the action figure, and the lower line depends from the lower reel mechanism, which is biased to reel in the lower line. A fixing mechanism holds a lower end of the lower line. A switch is operably connected to the upper reel mechanism and is switchable between (i) an active state, in which the upper reel mechanism is activated to wind in the upper line, and (ii) an inactive state, in which the upper reel mechanism is not activated to wind in the upper line and allows the upper line to be unwound therefrom. In the active state, the action figure is pulled toward the upper reel and the lower line is unwound from the lower reel mechanism. In the inactive state, the lower reel mechanism winds the lower line into the action figure as the action figure moves toward the fixing mechanism. A reciprocating mechanism is designed to translate rotation of the lower reel mechanism into reciprocation of at least one pivotably-mounted appendage only when the lower rope is unwound therefrom.

21 Claims, 5 Drawing Sheets

MECHANICAL CLIMBING TOY

BACKGROUND OF THE INVENTION

1. Field of the Invention

The present invention relates generally to a mechanical toy or animated display. More particularly, the present invention relates to a mechanical toy or animated display in which an action figure appears to climb and descend a rope.

2. Description of the Related Art

Many attempts have been made to provide climbing toy figures, advertising devices, and animated displays in which a figurine is made to appear to be climbing up or sliding down a rope, a pole, a chimney, or the like. Various approaches have been taken to achieve the appearance of climbing.

Several of these approaches provide for a figure which moves upwardly when a cord is pulled and descends when the tension is released.

U.S. Pat. No. 485,713 (Shattuck), U.S. Pat. No. 1,267,608 (Vaughan), U.S. Pat. No. 1,462,090 (Lindstrom), and U.S. Pat. No. 2,064,119 (Irenius) each relates to a climbing toy, and U.S. Pat. No. 3,983,661 (Zitzmann) relates to a gearing for toy figures. Each disclosed device includes a differential pulley having large and small spool portions. A first cord is attached to the larger spool and a second cord is attached to the smaller spool. When the first cord is pulled, the second cord will be wound and the toy will climb. When the first cord is released, the toy will descend.

Each device has a cam mechanism for driving the limbs of the toy. Most link the limbs via connecting rods directly to the differential pulley or a crank-type mechanism extending from the axis of the pulley. Some use alternate means, such as "rockers" which are contacted by a cam on the pulley as it rotates. Each, however, causes the limbs to move when the pulley rotates in either direction.

U.S. Pat. No. 243,439 (Farnum) relates to a slightly different climbing toy having a body through which a cord passes. A plurality of rods are pivotally interconnected, and the cord is passed around and through various shafts, pulleys, springs, and loops on the rods. When the cord is pulled downwardly, the various rods pivot and compress a spring. When the tension on the cord is released, the spring expands and returns the rods to their old relative positions, causing the body to move relative to the cord.

One problem with each of the above-discussed approaches (differential-pulley-type and otherwise) is the lack of a mechanism for continuous climbing and descending without manual assistance. Another problem is that none provides a mechanism which causes the appendages of the figure to move only as the figure climbs. Some attempts have been made to provide one or both of these arrangements.

For instance, U.S. Pat. No. 568,854 (Kenny) relates to an automatic figure advertising device in which a figure is moved up and down along a pole via a rope, which is wound about a drum by a motor. A friction wheel turns against the pole as the figure ascends and rotates a ratchet wheel which causes the arms and legs of the figure to move. When the motor makes a predetermined number of revolutions, a clutch is released, allowing the figure to descend due to its own weight. The ratchet-wheel remains stationary as the figure descends, so that the arms and legs do not move.

U.S. Pat. No. 2,304,697 (Kreutzer) relates to a mechanical toy having a figure member attached to a carriage member that is slidably supported by a pair of guide rods. An upper and lower driving means each includes a drum and a cable attached between the drum and the carriage member. A spring motor drives the drum of the lower driving means. The upper driving means includes a power spring affixed to the upper drum. As the spring motor winds the lower cable around the lower drum, the carriage member and figure member are drawn downwardly. At the same time, the upper cable unwinds from the upper drum, causing it to rotate and store spring energy in the power spring. When the carriage member reaches the bottom of the casing, it causes a clutch to disengage, allowing the power spring to rotate the upper drum and pull the carriage member upward.

U.S. Pat. No. 3,916,548 (Langer) relates to an animated window display having a Santa figurine affixed to a figurine support member. The support member is in turn connected to a sleeve and has a rearwardly-extending lip. A closed loop chain travels around a pair of sprocket wheels mounted at the top and bottom of the display. At the bottom of the rotation, a projection on the chain engages and lifts the lip of the support member, causing the figurine to be moved to the top of the display. The projection disengages from the lip at the top of the path of the chain and allows the support member to slide back down by gravity.

One additional arrangement appears in U.S. Pat. No. 4,245,486 (Matsumoto, et al.), which relates to a retractable charm device having a body connected to a linking sphere via an energization cord. The energization cord is attached to a take-up spool mounted in the body and coupled to a spring and a gear train connected to the appendages. When the body is pulled away from linking sphere, the energization cord is unwound and the take-up spool is rotated to store spring energy in the spring. When the body is released, the spring rotates the take-up spool to wind up the energization cord and rotates the gear train to move the appendages.

A problem with the devices discussed above, and those generally known, is that none provides an action figure which appears to repeatedly and automatically climb and slide down a free-hanging rope, with appendages that move to simulate the climbing motion and remain idle to simulate the sliding motion. Thus, it is desirable to provide a mechanical toy or display having an action figure with more realistic motions to simulate climbing and sliding down a rope. It is also desirable to provide such a toy or display in which the action figure automatically repeats its climbing and sliding simulations.

SUMMARY OF THE INVENTION

It is a general object of the present invention to provide a mechanical climbing toy or display with an action figure having realistic movement to simulate climbing and sliding down a rope.

It is further an object of the present invention to provide such a toy or display in which the action figure appears to climb and slide down a single, free-hanging rope.

It is still another object of the invention to provide such a toy or display in which the action figure moves its appendages to simulate a climbing motion as it ascends.

It is yet another object of the invention to provide such a toy or display in which the action figure has appendages which remain idle as it descends to simulate sliding down the rope.

It is still a further object of the present invention to provide such a toy or display in which the action figure will continuously repeat the climbing and sliding motions.

In accordance with one aspect of the present invention, a climbing toy is provided which includes an upper line and a lower line. An upper reel mechanism, from which the upper line depends, selectively reels in the upper line. An action figure is connected to a lower end of the upper line. A lower reel mechanism is disposed in the action figure, and the lower line depends from the lower reel mechanism, which is biased to reel in the lower line. Fixing means are provided for holding a lower end of the lower line.

A switch is operably connected to the upper reel mechanism. The switch is operable between (i) an active state, in which the upper reel mechanism is activated to reel in the upper line, pulling the action figure toward the upper reel and causing the lower line to be unreeled from the lower reel mechanism, and (ii) an inactive state, in which the upper reel mechanism is not activated to reel in the upper line and allows the upper line to be unreeled therefrom, allowing the lower reel mechanism to reel the lower line into the action figure, so that the action figure moves toward the fixing means. The switch can be actuated to the active state as an upper portion of the upper line is unreeled from the upper reel mechanism, and the switch can further be switched into the inactive state as a lower portion of the upper line is reeled into the upper reel mechanism.

At least one appendage can be provided, with the appendage secured at a pivot to the action figure. Reciprocation means can be provided for selectively translating rotation of the lower reel mechanism into reciprocation of each appendage. The toy can be designed so that the reciprocation means only translates the rotation of the lower reel mechanism into the reciprocation of each appendage when the rotation of the lower reel mechanism is such that the lower rope is unreeled therefrom, so that each appendage reciprocates when the action figure is pulled toward the upper reel mechanism and idles when the action figure moves toward the fixing means.

The reciprocation means can include a main gear fixed to and having a common axis of rotation with the lower reel mechanism. A swivel arm can be provided with an inner end rotatably secured to the common axis of rotation.

A planetary gear can be rotatably attached to an outer end of the swivel arm and be driven by the main gear. An offset gear can be selectively engaged and driven by the planetary gear. At least one connector rod can be provided, pivotally secured at a respective proximal end to the offset gear and at a respective distal end to a different appendage. When the lower line is being unreeled from the lower reel mechanism, the swivel arm is swiveled by the rotation of the lower reel mechanism so that the planetary gear engages and drives the offset gear. When the lower reel mechanism reels in the lower line, the swivel arm is swiveled by the rotation of the lower reel mechanism so that the planetary gear is disengaged from and does not drive the offset gear.

The lower reel mechanism can include a coil spring, and the lower reel mechanism can be biased by the coil spring to reel in the lower line. The upper reel mechanism can include a motor which is engaged and disengaged by the switch, and the fixing means can be a weight.

Included among the at least one appendage can be a figure arm, secured at an upper pivot to the action figure, slidably secured to the upper line at a hand seat, and having a movable elbow joint between the upper pivot and the hand seat. Also included can be a figure leg, secured at a lower pivot to the action figure, slidably secured to the lower line at a foot seat, and having a movable knee joint between the lower pivot and the foot seat. In this case, a figure-arm connector rod can be pivotally secured at the distal end thereof to the figure arm, and a figure-leg connector rod can be pivotally secured at the distal end thereof to the figure leg. The reciprocation of the figure arm causes the hand seat to slide up and down the upper line, and the reciprocation of the figure leg causes the foot seat to slide up and down the lower line.

The upper line can have a protrusion positioned to contact and actuate the switch into the active state as the upper portion of the upper line is unreeled from the upper reel mechanism. The action figure can contact and switch the switch into the inactive state as the lower portion of the upper line is reeled into the upper reel mechanism.

In another form of the present invention, a climbing toy has an upper line, a lower line, and an upper reel mechanism from which the upper line depends and which can be selectively activated to reel in the upper line. An action figure is connected to a lower end of the upper line. A lower reel mechanism is disposed in the action figure, and the lower line depends from the lower reel mechanism, which is biased to reel in the lower line when the upper reel mechanism is not activated, and from which the lower line is unreeled when the upper reel mechanism reels in the upper line. Fixing means are provided for holding a lower end of the lower line. At least one appendage is pivotally secured at a respective pivot to the action figure. A reciprocating mechanism is disposed within the action figure and is operably engaged to the lower reel mechanism and each appendage. The reciprocating mechanism translates rotation of the lower reel mechanism into reciprocation of each appendage only as the lower line is unreeled from the lower reel mechanism. A switch is operably connected to the upper reel mechanism for selectively activating and deactivating the upper reel mechanism to reel in the upper line.

In yet another form of the present invention, a climbing toy has an upper line, a lower line, and an upper reel mechanism from which the upper line depends and which selectively reels in the upper line. An action figure is connected to a lower end of the upper line. A lower reel mechanism is disposed in the action figure, and the lower line depends from the lower reel mechanism, which is biased to reel in the lower line, and from which the lower line is unreeled when the upper reel mechanism reels in the upper line. Fixing means are provided for holding a lower end of the lower line. An appendage is pivotally secured at a pivot to the action figure. A reciprocating mechanism is disposed within the action figure and is operably engaged to the lower reel mechanism and the appendage. The reciprocating mechanism translates rotation of the lower reel mechanism into reciprocation of the appendage only as the lower line is unreeled from the lower reel mechanism.

According to a further aspect of the present invention, a gearing mechanism is provided for an action figure with a pivotally connected appendage. A lower reel mechanism is disposed in the action figure, and a line depends from the lower reel mechanism, which is biased to reel in the line. A main gear is fixed to and has a common axis of rotation with the lower reel mechanism. A swivel arm is provided with an inner end rotatably secured to the common axis of rotation. A planetary gear is rotatably attached to an outer end of the swivel arm and is driven by the main gear. An offset gear is selectively engaged and driven by the planetary gear. A connector rod is pivotally secured at a proximal end to the offset gear and at a distal end to the appendage.

When the line is being unreeled from the reel mechanism, the swivel arm is swiveled by the rotation of the reel mechanism so that the planetary gear engages and drives the offset gear, causing the appendage to reciprocate. When the reel mechanism reels in the line, the swivel arm is swiveled by the rotation of the reel mechanism so that the planetary gear is disengaged from and does not drive the offset gear.

Accordingly, the present invention provides a mechanical climbing toy or display having an action figure that seems to climb and descend a single, free-hanging rope in a realistic fashion.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1A:
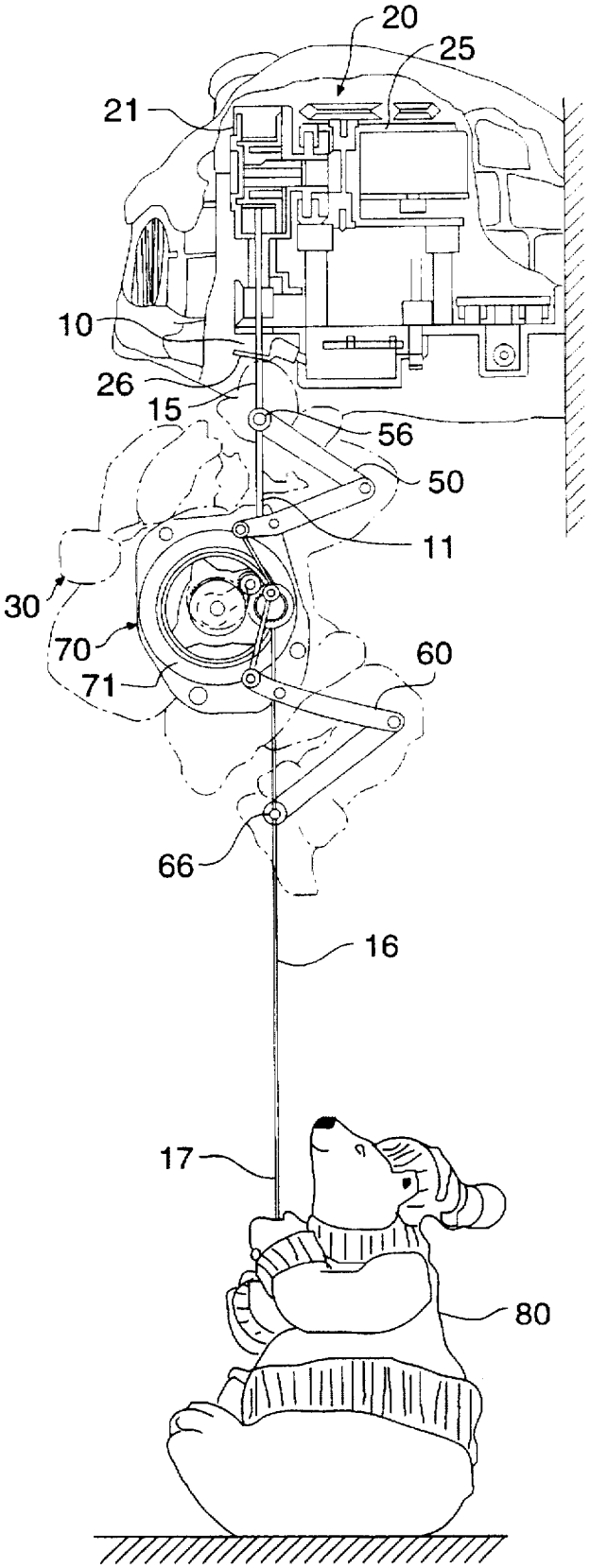
FIG. 1A is a partial cross-sectional view, in elevation, of a preferred embodiment of the mechanical climbing toy or display in accordance with the present invention.

FIG. 1A is a partial cross-sectional view of a first embodiment of the mechanical climbing toy or display in accordance with the present invention. As shown, an action FIG. 30 depends from an upper line 10, which in turn depends from a motorized upper reel mechanism 20. A lower line 16 depends from a lower reel mechanism 70 which is housed in the action FIG. 30. The lower line 16 is held at its bottom by a weight 80 or other suitable fixing means. In this illustration, the action FIG. 30, the motorized upper reel mechanism 20, and the weight 80 are decorated, respectively, as Santa Claus, an igloo, and a polar bear. The particular decorative appearance of each of these elements is not critical to the invention, and any desired motif may be employed.

A lower end 11 of the upper line 10 is attached to a fixed position on the action FIG. 30. Preferably, the upper line 10 is attached to the action FIG. 30 so as to be aligned with the lower line 16 as it depends from the lower reel mechanism 70. Thus, if the upper and lower lines 10, 16 have similar coloring and are constructed of the same or similar material, they appear to be a single, continuous rope.

As the upper reel mechanism 20 reels in the upper line 10, the action FIG. 30 will be pulled upward. As this occurs, the lower line 16 will unreel from the spring-loaded lower reel mechanism 70. The spring-loading of the lower reel mechanism 70 keeps the lower line 16 taut between the action FIG. 30 and the weight 80. Conversely, when the upper line 10 is allowed to unreel from the upper reel mechanism 20, the spring-loaded lower reel mechanism 70 will take up the slack in the lower line 16 as the action FIG. 30 descends. This creates the illusion that the action FIG. 30 is climbing up and down a single, continuous rope. If the spring-loading of the lower reel mechanism 70 and the pull of the upper reel mechanism 20 are sufficiently strong, then the upper and lower lines 10, 16 can be held taut even if they are not vertical.

To create a more realistic image, the action FIG. 30 is provided with pivotally mounted appendages. In the embodiments shown in the figures, the action FIG. 30 is provided with arms that move together as a single appendage 50 and legs that move together as a single appendage 60. Although not necessary, it is preferred that the arms 50 be jointed and slidably attached at hands 56 to the upper line 10. Likewise, the legs 60 are preferably shifted and slidably attached at feet 66 to the lower line 16. The particulars of the construction and operation of the appendages 50, 60 will be discussed in more detail below. It is important to note now, however, that more or less than two appendages could be employed in the present invention.

As shown in FIG. 1A, the upper reel mechanism 20 includes an upper reel 21 which is driven by a motor 25. Power for the motor may be supplied by a battery, line current or other suitable means (not shown). Depending on the positioning of the motor and the upper reel, an array of gears, endless belts or other comparable means are used to transfer rotary motion from the motor to the upper reel. A toggle switch 26, the operation of which will be described in detail below, selectively engages and disengages the motor 25. When the motor 25 is engaged, it drives the upper reel mechanism 20 to wind the upper line 10 onto the upper reel 21. This pulls the action FIG. 30 toward the upper reel mechanism 20, causing the lower line 16 to unwind from the lower reel mechanism 70. On the other hand, when the motor 25 is disengaged, the upper reel 21 idles. Thus, the upper reel mechanism 20 permits the upper line 10 to unwind from the upper reel 21. This allows the action FIG. 30 to descend away from the upper reel mechanism 20. As this happens, the lower reel mechanism 70 winds in the lower line 16.

The toggle switch 26 is preferably designed so that it is actuated to engage the motor when the action FIG. 30 moves some distance away from the upper reel mechanism 20, and so that it is actuated to disengage the motor 25 when the action FIG. 30 approaches close to the upper reel mechanism 20. In this way, it can be made to appear that the action FIG. 30 is repeatedly climbing up and descending down a single rope.

Figure 1B:
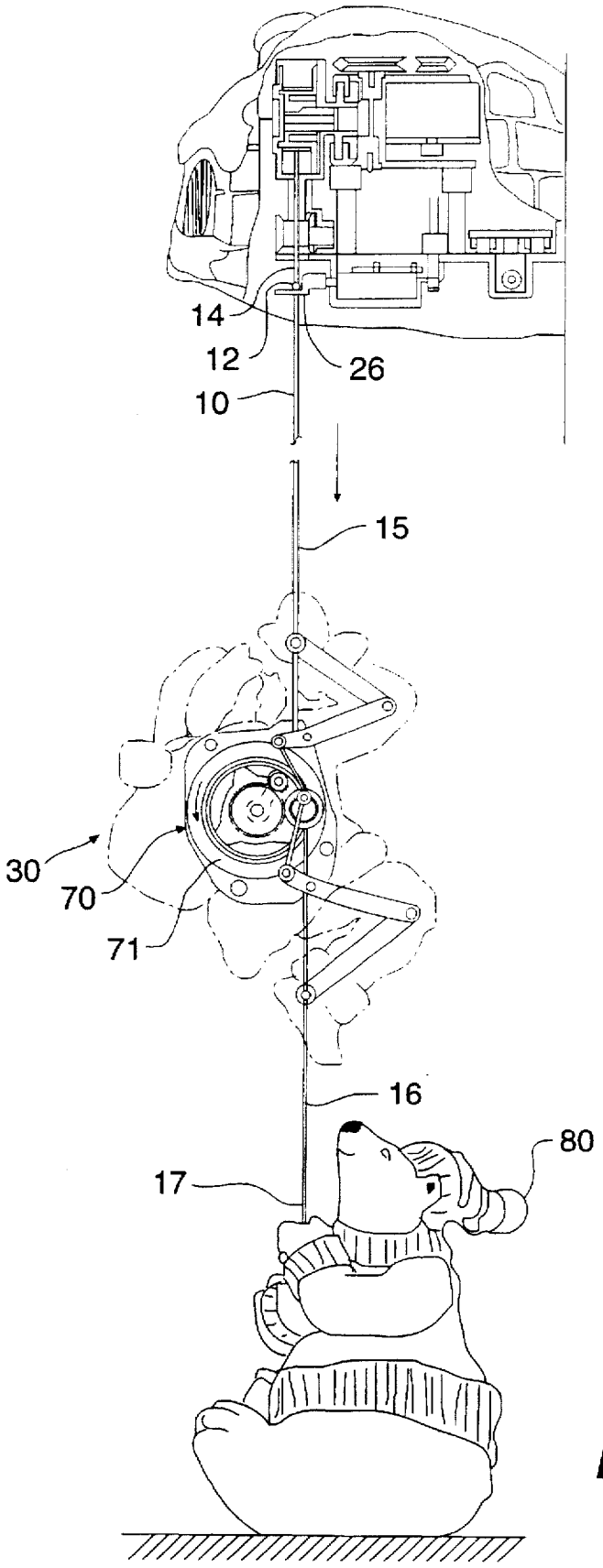
FIG. 1B is a partial cross-sectional view, in elevation, illustrating a switching operation of the embodiment shown in FIG. 1A.

In order to accomplish this action, the toggle switch 26 can be placed near the upper line 10, so that protrusions formed on the upper line 10 will contact and actuate the toggle switch 26. In the embodiment shown in FIG. 1B, a protrusion 12 is provided on the upper portion 14 of the upper line 10. As the upper line 10 unwinds from the upper reel mechanism 20, the protrusion 12 will contact and force the toggle switch 26 downwardly, as shown, actuating the toggle switch 26 to engage the motor 25. The protrusion 12 can be formed by fixing a bead or other object to the upper line 10, by tying a knot in the upper line 10, or by any other suitable means. A similar protrusion can be formed on the lower portion 15 of the upper line 10, near the action FIG. 30, for actuating the toggle switch 26 to disengage the motor 25 as the action FIG. 30 approaches the upper reel mechanism 20. Alternately, the action FIG. 30 can be configured to itself contact the toggle switch 26, such as by the hand 56, forcing it up as shown in FIG. 1A.

Figure 2:
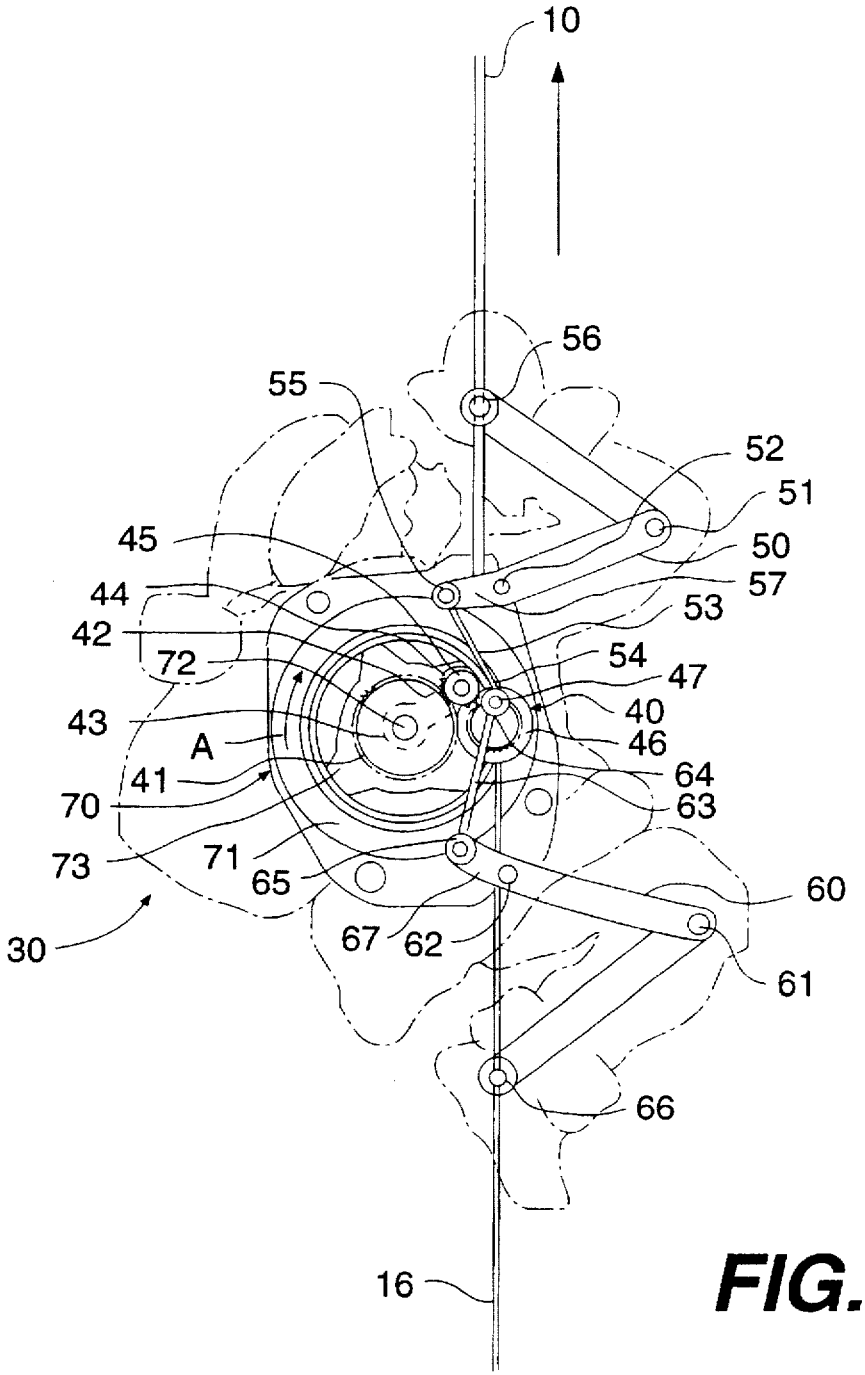
FIG. 2 is a detailed view of the action figure element of the present invention as shown in FIG. 1, in the climbing mode.

The details of the construction and operation of the action FIG. 30 are shown in FIG. 2. More specifically, as the upper line 10 is wound into the upper reel 21 by the upper reel mechanism 20, the action FIG. 30 is pulled upwardly. As this occurs, the lower line 16, which is fixed at its lower end by the weight 80, is unwound from a lower reel 71 of the lower reel mechanism 70. The torsion applied by the motor 25 to the upper reel mechanism 20 overcomes the torsion applied to the lower reel 71 by a coil spring 73, which biases the lower reel 71 to wind in the lower line 16. Thus, the coil spring 73 is loaded as the lower line 16 is unwound from the lower reel 71. This loading of the coil spring 73 will cause the lower reel mechanism 70 to wind the lower line 16 back in once the motor 25 is disengaged. As will be appreciated, comparable alternatives to the coil spring 73 to store energy when the lower line is unwound and bias the lower reel 71 to wind in the lower line can be used without departing from the scope of the invention.

The action FIG. 30 is also provided with a reciprocating mechanism 40, which interacts with the lower reel mechanism 70 to activate the appendages. The reciprocating mechanism 40 includes a main gear 41 fixed to and sharing an axis of rotation 72 with the lower reel 71. Thus, the main gear 41 will rotate synchronously with the lower reel 71. A swivel arm 42 is also pivotably connected at its inner end 43 to the axis of rotation 72. At the outer end 44 of the swivel arm 42 and interfacing with the main gear 41 is a planetary gear 45.

As the lower line 16 unwinds from the lower reel mechanism 70, the main gear 41 will rotate in the direction indicated by arrow A. This rotation of the main gear 41 will in turn force the planetary gear 45, at the outer end 44 of the swivel arm 42, to swing in the same direction until it comes into contact with an offset gear 46, which is mounted in the action figure on a fixed shaft (not shown). This offset gear 46 is spaced from the main gear 41, so that the rotation of the main gear 41 will only be communicated to the offset gear 46 when the planetary gear 45 is contacting both, as shown in FIG. 2. When the planetary gear 45 contacts the offset gear 46, it will be obstructed from swinging further in the direction indicated by arrow A. At this point, the rotation of the main gear 41 will force the planetary gear 45 to rotate on its axis. As the main gear 41 drives the planetary gear 45, the planetary gear 45 will in turn drive the offset gear 46.

A connector rod 53 is connected at its proximal end 54 to a cam point 47 on the offset gear 46. The distal end 55 of the connector rod 53 is pivotably connected to an extension 57 of the figure arm 50, which is also mounted in the action figure on a fixed pivot 52. As the offset gear 46 is driven by the planetary gear 45, the proximal end 54 of the connector rod 53 will orbit the axis of rotation of the offset gear 46. This will cause the distal end 55 of the connector rod 53 and the extension 57 of the figure arm 50 to reciprocate (on an arc centered at the pivot 52 between the figure arm 50 and the action FIG. 30). Thus, the rotation of the offset gear 46 will be transmitted through the connector rod 53 into reciprocation of the extension 57. This reciprocation will be transmitted through the pivot 52 to the remainder of the figure arm 50. The figure arm 50 has a movable elbow joint 51 and is slidably connected to the upper line 10 at its hand 56. The hand 56, therefore, will be caused to slide up and down along the upper line 10 as the offset gear 46 rotates.

Similarly, a connector rod 63 is pivotably connected at its proximal end 64 to the cam point 47 of the offset gear 46. The distal end 65 of the connector rod 63 is connected pivotably to an extension 67 of the figure leg 60, which is mounted for reciprocal movement on a pivot 62 fixed within the action figure. The connector rod 63 will thus translate the rotation of the offset gear 46 into reciprocation of the extension 67. This reciprocation will be transmitted through the pivot 62 on the action FIG. 30 to the remainder of the figure leg 60. The figure leg 60 has a movable knee joint 61 and is slidably connected at foot 66 to lower line 16. Thus, as the offset gear 46 rotates, the foot 66 will be caused to slide up and down the lower line 16.

It should be noted that the appendages 50, 60 need not be jointed or slidably connected to the upper and lower lines 10, 16. These features enhance the realism of the simulated climbing and sliding motions, and are therefore preferred. However, an acceptable simulation could be achieved with one-piece appendages 50, 60 which are not connected to the lines 10, 16, but merely reciprocate near the lines 10, 16 to simulate the climbing motion.

When the toggle switch 26 is actuated to disengage the motor 25, the upper reel mechanism 20 will allow the upper line 10 to be unwound from the upper reel 21. When this occurs, the action FIG. 30 will descend. It should be noted that the descent can be driven by either the weight of the action FIG. 30 (i.e., gravity) or the stored tension in the coil spring 73, or both, depending upon various design considerations. In addition, the motor 25 could be switched into a reversed state, in which it actively unreels the upper line 10 from the upper reel 21, instead of disengaging from the upper reel 21. The particular mechanics of this operation are not an essential element of the invention, so long as the descent occurs.

Figure 3:
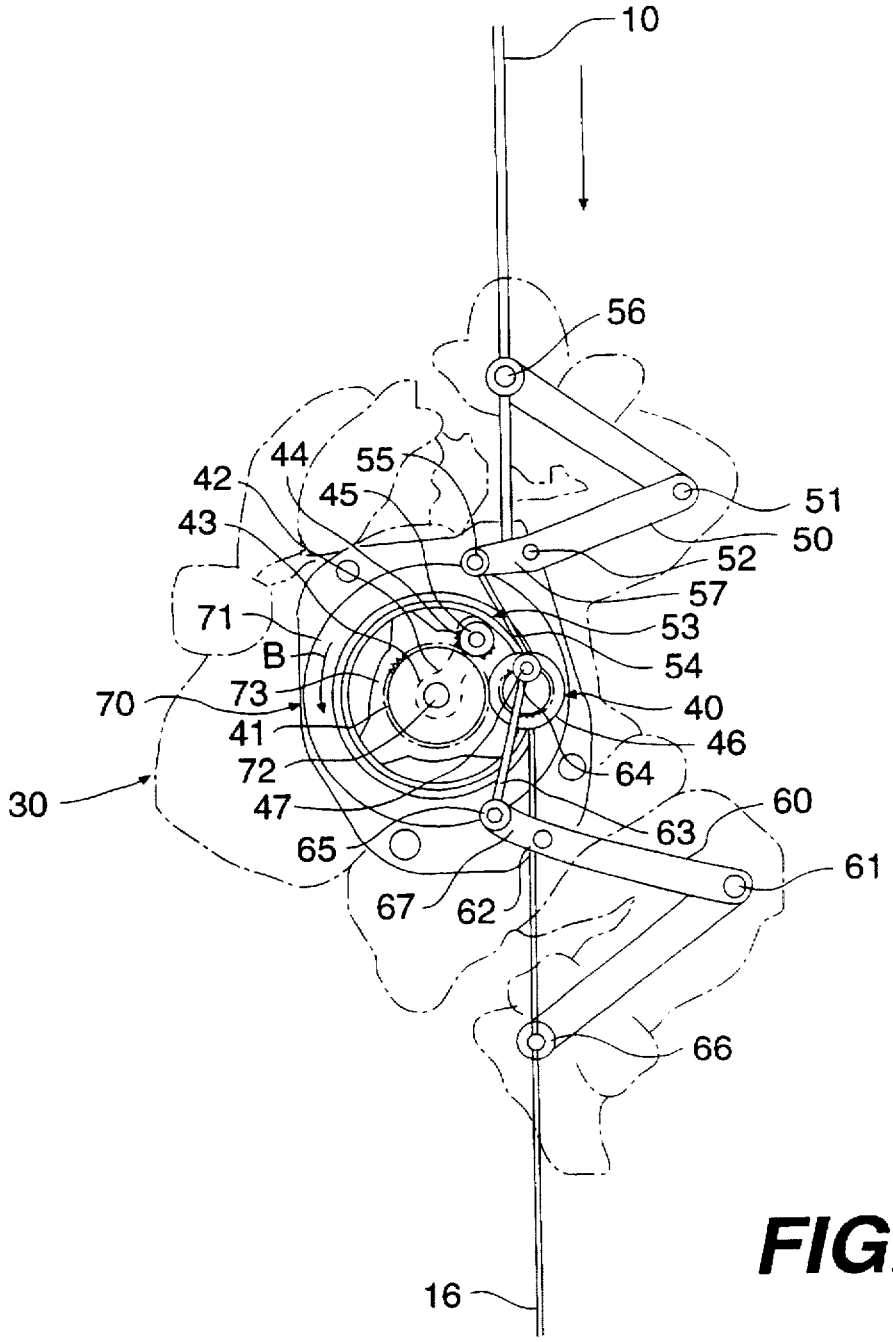
FIG. 3 is a detailed view of the action figure element of the present invention as shown in FIG. 1, in the descending mode.

The stored energy in the coil spring 73 will cause the lower reel 17 to reel in the lower line 16 as the action FIG. 30 descends. As this occurs, the planetary gear 45 on the outer end 44 of the swivel arm 42, will be swiveled by the rotation of the main gear 41 away from the offset gear 46 in the direction indicated by arrow B in FIG. 3. Any suitable means, such as a stopper to block the rotation of swivel arm 42 or a free-standing gear to engage the planetary gear 45, can be provided to prevent the planetary gear 45 from being swiveled far enough around the main gear 41 in the direction indicated by arrow B to engage the offset gear 46 on the opposite side. In this position, the planetary gear 45 is isolated from the offset gear 46, and therefore cannot transmit the rotation of the main gear 41 to the offset gear 46. Thus, the offset gear 46 will remain idle, as consequently will the appendages 50, 60.

As will be appreciated, the reciprocating mechanism translates the rotation of the lower reel 71 into reciprocation of the appendages 50, 60 as the lower reel mechanism 70 unwinds the lower line 16. This reciprocating mechanism will not, however, translate the rotation of the lower reel 71 into reciprocation of the appendages 50, 60 when the lower reel mechanism 70 winds in the lower line 16. Thus, the appendages 50, 60 will move back and forth as the action FIG. 30 is drawn upward toward the upper reel mechanism 20, but will idle as the action FIG. 30 is allowed to descend away from the upper reel mechanism 20. This creates the impression that the action FIG. 30 is climbing up and sliding back down a single, continuous rope. It should be noted that if it is desired to provide an action FIG. 30 which simulates climbing down as well as up, the main gear 41 can be directly interfaced with the offset gear 46 (or the connector rods 53, 63 could be connected directly to the main gear 41), so that the appendages 50, 60 are driven regardless of the direction of rotation of the lower reel 71.

Figure 4A:
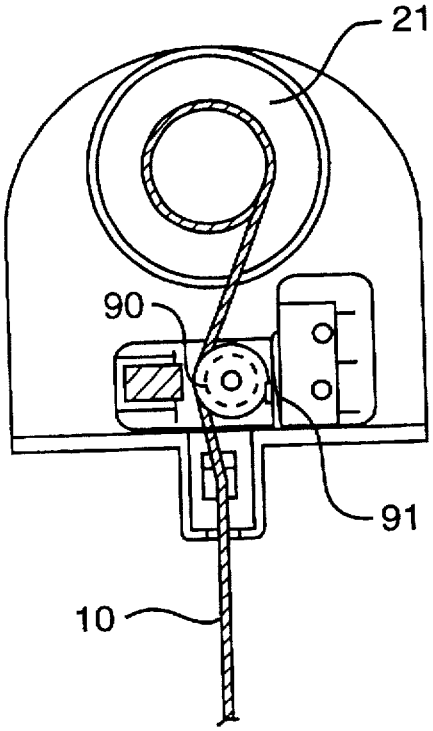
FIG. 4A is a detailed view of the upper reel mechanism of the present invention as shown in FIG. 1, showing a safety switch mechanism in the closed position.
Figure 4B:
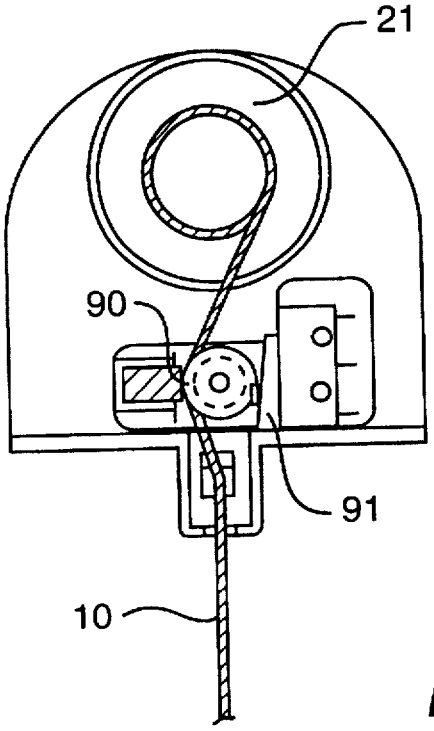
FIG. 4B is a detailed view as shown in FIG. 4A, showing the safety switch in the open position.

A safety mechanism to reduce the likelihood of damage to the upper reel 20 and the motor 25 is shown in FIGS. 4A and 4B. During normal operation, as shown in FIG. 4A, the weight of the action FIG. 30, as well as the pull of coil spring 73 on the lower line 16, will provide tension to the upper line 10. This tension on the upper line 10 will push an activator roller 90 into contact with a security switch 91. This action closes the security switch 91, connecting the motor 25 to power.

FIG. 4B illustrates the action of the safety mechanism when the action FIG. 30 is not properly hanging from the upper line 10. The lack of tension in the upper line 10 allows the activator roller 90 to release the security switch 91, which is biased into the open position, as shown. With the security switch 91 open, no power is provided to the motor 25. Thus, if for any reason the action FIG. 30 is not properly hanging on the upper line 10, the upper reel mechanism will be disengaged.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to accorded the broadest interpretation so as to encompass such modifications and equivalent structures.

What is claimed is:

1. A climbing toy comprising:

an upper line;

a lower line;

fixing means for holding a lower end of said lower line;

an action figure connected to a lower end of said upper line;

an upper reel mechanism for selectively winding and unwinding said upper line;

a lower reel mechanism disposed in said action figure for unwinding and winding said lower line, said lower reel mechanism being arranged to unwind said lower line when said upper reel mechanism winds said upper line, and to wind said lower line when said upper reel mechanism unwinds said upper line;

an appendage pivotably mounted about a pivot in said action figure; and a reciprocating mechanism disposed within said action figure and operably engaged with said lower reel mechanism and said appendage, said reciprocating mechanism being arranged for translating rotation of said lower reel mechanism into reciprocation of said appendage only as said lower line is unwound from said lower reel mechanism.

2. The climbing toy of claim 1, wherein said reciprocating mechanism comprises:

a main gear fixed to and having a common axis of rotation with said lower reel mechanism;

a swivel arm having an inner end rotatably secured to the common axis of rotation;

a planetary gear rotatably attached to an outer end of said swivel arm and driven by said main gear;

an offset gear mounted for rotation in said action figure, which is selectively engaged and driven by said planetary gear; and a connector rod, pivotably secured at a proximal end to said offset gear and at a distal end to said appendage, wherein, when said lower line is being unwound from said lower reel mechanism, said swivel arm is swiveled by the rotation of said lower reel mechanism so that said planetary gear engages and drives said offset gear, and wherein, when said lower reel mechanism winds in said lower line, said swivel arm is swiveled by the rotation of said lower reel mechanism so that said planetary gear is disengaged from and does not drive said offset gear.

3. A climbing toy comprising:

an upper line;

a lower line;

fixing means for holding a lower end of said lower line;

an upper reel mechanism for selectively winding and unwinding said upper line;

an action figure connected to a lower end of said upper line;

a lower reel mechanism disposed in said action figure, for unwinding and winding said lower line, said lower reel mechanism being arranged to unwind said lower line when said upper reel mechanism winds said upper line, and to unwind said lower line when said upper reel mechanism unwinds said upper line;

at least one appendage, pivotably mounted about a respective pivot in said action figure;

a reciprocating mechanism disposed within said action figure and operably engaged with said lower reel mechanism and each said appendage, said reciprocating mechanism being arranged for translating rotation of said lower reel mechanism into reciprocation of each said appendage only as said lower line is unwound from said lower reel mechanism; and a switch for selectively actuating said upper reel mechanism to wind and unwind said upper line.

4. The climbing toy of claim 3, wherein said reciprocating mechanism comprises:

a main gear fixed to and having a common axis of rotation with said lower reel mechanism;

a swivel arm having an inner end rotatably secured to the common axis of rotation;

a planetary gear rotatably attached to an outer end of said swivel arm and driven by said main gear;

an offset gear mounted for rotation in said action figure, which is selectively engaged and driven by said planetary gear; and at least one connector rod, pivotably secured at a respective proximal end to said offset gear and at a respective distal end to a different one of said at least one appendage, wherein, when said lower line is being unwound from said lower reel mechanism, said swivel arm is swiveled by the rotation of said lower reel mechanism so that said planetary gear engages and drives said offset gear, and wherein, when said lower reel mechanism winds in said lower line, said swivel arm is swiveled by the rotation of said lower reel mechanism so that said planetary gear is disengaged from and does not drive said offset gear.

5. The climbing toy of claim 3, further including a spring mounted in said action figure for biasing said lower reel to wind in said lower line.

6. The climbing toy of claim 3, further including a motor operated by said switch for driving said upper reel mechanism to wind and unwind said upper line.

7. The climbing toy of claim 3, further including a protrusion carried on said upper line for contacting said switch to actuate said upper reel mechanism when an upper portion of the upper line is unwound therefrom, and wherein said action figure is configured for contacting said switch to deactuate said upper reel mechanism when said upper line is unwound into said upper reel mechanism.

8. The climbing toy of claim 4, wherein:

said at least one appendage comprises (i) a figure arm, pivotably mounted on at an upper pivot in said action figure, slidably secured at a location remote from said upper pivot to said upper line at a hand seat, and having a movable elbow joint between said upper pivot and said hand seat, and (ii) a figure leg, pivotably mounted at a lower pivot in said action figure, slidably secured at a location remote from said lower pivot to said lower line at a foot seat, and having a movable knee joint between said lower pivot and said foot seat; and said at least one connector rod comprises a figure-arm connector rod, pivotably secured at the distal end thereof to said figure arm, and a figure-leg connector rod, pivotably secured at the distal end thereof to said figure leg, wherein reciprocation of said figure arm causes said hand seat to slide up and down said upper line, and the reciprocation of said figure leg causes said foot seat to slide up and down said lower line.

9. A climbing toy comprising:

an upper line;

a lower line;

fixing means for holding a lower end of said lower line; and an upper reel mechanism for selectively winding and unwinding said upper line;

an action figure connected to a lower end of said upper line;

a lower reel mechanism disposed in said action figure, for unwinding and winding said lower line, said lower reel mechanism being arranged to unwind said lower line when said upper reel mechanism winds said upper line, and to wind said lower line when said upper reel mechanism unwinds said upper line; and a switch operably connected to said upper reel mechanism and actuatable between (i) an active state, in which said upper reel mechanism is operated to wind in said upper line, and (ii) an inactive state, in which said upper reel mechanism is not activated.

10. The climbing toy of claim 9, wherein said switch is configured to be actuated into the active state as an upper portion of said upper line is unwound from said upper reel mechanism, and to be actuated to the inactive state as a lower portion of said upper line is wound onto said upper reel mechanism.

11. The climbing toy of claim 9, further comprising:

at least one appendage, pivotably mounted on at a respective pivot in said action figure; and reciprocating means for selectively translating rotation of said lower reel mechanism into reciprocation of each said appendage.

12. The climbing toy of claim 11, wherein said reciprocating means is configured to only translate rotation of said lower reel mechanism into the reciprocation of each said appendage when said lower line unwound therefrom, such that each said appendage reciprocates when said action figure is pulled toward said upper reel mechanism and idles when said action figure moves toward said fixing means.

13. The climbing toy of claim 12, wherein said reciprocating means comprises:

a main gear fixed to and having a common axis of rotation with said lower reel mechanism;

a swivel arm having an inner end rotatably secured to the common axis of rotation;

a planetary gear rotatably attached to an outer end of said swivel arm and driven by said main gear;

an offset gear mounted for rotation in said action figure which is selectively engaged and driven by said planetary gear; and at least one connector rod, pivotably secured at a respective proximal end to said offset gear and at a respective distal end to a different one of said at least one appendage, wherein, when said lower line is being unwound from said lower reel mechanism, said swivel arm is swiveled by the rotation of said lower reel mechanism so that said planetary gear engages and drives said offset gear, and wherein, when said lower mechanism winds in said lower line, said swivel arm is swiveled by the rotation of said lower reel mechanism so that said planetary gear is disengaged from and does not drive said offset gear.

14. The climbing toy of claim 9, further comprising a spring mounted in said action figure for biasing said lower reel mechanism to wind said lower line.

15. The climbing toy of claim 9, further including a motor operated by said switch for driving said upper reel mechanism to wind and unwind said upper line.

16. The climbing toy of claim 9, wherein said fixing means is a weight.

17. The climbing toy of claim 11, wherein:

said at least one appendage comprises (i) a figure arm, pivotably mounted on an upper pivot in said action figure, slidably secured at a location remote from said upper pivot to said upper line at a hand seat, and having a movable elbow joint between said upper pivot and said hand seat, and (ii) a figure leg, pivotably mounted on a lower pivot in said action figure, slidably secured at a location remote from said lower pivot to said lower line at a foot seat, and having a movable knee joint between said lower pivot and said foot seat; and said at least one connector rod comprises a figure-arm connector rod, pivotably secured at the distal end thereof to said figure arm, and a figure-leg connector rod, pivotably secured at the distal end thereof to said figure leg, wherein reciprocation of said figure arm causes said hand seat to slide up and down said upper line, and the reciprocation of said figure leg causes said foot seat to slide up and down said lower line.

18. The climbing toy of claim 17, wherein said figure arm and said figure leg each have an extension opposite said respective movable joint of said respective pivot to which said figure-arm connector rod and said figure-leg connector rod are respectively connected.

19. The climbing toy of claim 9, further including a protrusion carried on said upper line for contacting and actuating said switch to the active state as said upper portion of said upper line is unwound from said upper reel mechanism, and wherein said action figure is configured for contacting and actuating said switch to the inactive state as said lower portion of said upper line is wound into said upper reel mechanism.

20. The climbing toy of claim 15, further comprising a power source for said motor and a safety mechanism operably connected to said motor and switchable between (i) an open position, in which said motor is not connected to said power source, and (ii) a closed position, in which said motor is connected to said power source, wherein said safety mechanism is biased to the open position, and wherein tension in said upper line forces said safety mechanism into said closed position when said action figure hangs from said upper line.

21. A gearing mechanism for an action figure with a pivotably mounted appendage, said gearing mechanism comprising:

a reel mechanism disposed in the action figure and from which a line depends, said reel mechanism being biased to wind in the line;

a main gear fixed to and having a common axis of rotation with said reel mechanism;

a swivel arm having an inner end rotatably secured to the common axis of rotation;

a planetary gear rotatably attached to an outer end of said swivel arm and driven by said main gear;

an offset gear which is selectively engaged and driven by said planetary gear; and a connector rod, pivotally secured at a proximal end to said offset gear and at a distal end to the appendage, wherein, when the line is being unwound from said reel mechanism, said swivel arm is swiveled by the rotation of said reel mechanism so that said planetary gear engages and drives said offset gear, causing the appendage to reciprocate, and wherein, when said reel mechanism winds the line, said swivel arm is swiveled by the rotation of said reel mechanism so that said planetary gear is disengaged from and does not drive said offset gear.

* * * * *

UNITED STATES PATENT AND TRADEMARK OFFICE

CERTIFICATE OF CORRECTION

PATENT NO. : 5,727,981

DATED : March 17, 1998

INVENTOR(S) : HUANG MENG-SUEN

It is certified that error appears in the above-indentified patent and that said Letters Patent is hereby corrected as shown below:

COLUMN 5:

Line 37, "FIG." should read --figure--.
Line 41, "FIG." should read --figure--.
Line 43, 'FIG." should read --figure--.
Line 50, "FIG." should read --figure--.
Line 51, 'FIG." should read --figure--.
Line 57, "FIG." should read --figure--.
Line 60, "FIG." should read --figure--.
Line 64, "FIG." should read --figure--.
Line 65, "FIG." should read --figure--.

COLUMN 6

Line 4, "FIG." should read --figure--.
Line 6, "FIG." should read --figure--.
Line 28, "FIG." should read --figure--.
Line 30, "0n" should read --On--.
Line 33, "FIG." should read --figure--.
Line 37, "FIG." should read --figure--.
Line 40, "FIG." should read --figure--.
Line 41, "FIG." should read --figure--.
Line 56, "FIG." should read --figure--.
Line 58, "FIG." should read --figure--.
Line 59, "FIG." should read --figure--.
Line 63, "FIG." should read --figure--.
Line 65, "FIG." should read --figure--.

UNITED STATES PATENT AND TRADEMARK OFFICE

CERTIFICATE OF CORRECTION

PATENT NO. : 5,727,981

DATED : March 17, 1998

INVENTOR(S) : HUANG MENG-SUEN

It is certified that error appears in the above-identified patent and that said Letters Patent is hereby corrected as shown below:

COLUMN 7

Line 14, "FIG." should read --figure--.
Line 50, "FIG." should read --figure--.
Line 66, "FIG." should read --figure--.

COLUMN 8

Line 15, "FIG." should read --figure--.
Line 17, "FIG." should read --figure--.
Line 26, "FIG." should read --figure--.
Line 48, "FIG." should read --figure--.
Line 49, "FIG." should read --figure--.
Line 51, "FIG." should read --figure--.
Line 53, "FIG." should read --figure--.
Line 62, "FIG." should read --figure--.

COLUMN 9

Line 2, "FIG." should read --figure--.
Line 6, "FIG." should read --figure--.

UNITED STATES PATENT AND TRADEMARK OFFICE

CERTIFICATE OF CORRECTION

PATENT NO. : 5,727,981 Page 3 of 3

DATED : March 17, 1998

INVENTOR(S) : HUANG MENG-SUEN

It is certified that error appears in the above-indentified patent and that said Letters Patent is hereby corrected as shown below:

COLUMN 10

Line 67, "on" should be deleted.

COLUMN 11

Line 44, "on" should be deleted.

Signed and Sealed this

Ninth Day of March, 1999

*Attest:*

*Attesting Officer*

Q. TODD DICKINSON

*Acting Commissioner of Patents and Trademarks*